United States Patent [19]

Peterson et al.

[11] Patent Number: 4,660,719

[45] Date of Patent: Apr. 28, 1987

[54] DRILL HOLDING CASE STRUCTURE

[75] Inventors: Seymour A. Peterson, Minneapolis; Peter G. Huot, St. Paul, both of Minn.

[73] Assignee: Huot Mfg. Co., St. Paul, Minn.

[21] Appl. No.: 800,039

[22] Filed: Nov. 20, 1985

[51] Int. Cl.[4] ..... B65D 85/28

[52] U.S. Cl. ..... 206/379; 206/45.13; 206/45.15; 206/45.18; 206/45.23; 206/372; 211/69

[58] Field of Search ..... 206/45.13, 45.15, 45.18, 206/45.23, 349, 372, 373, 379, 425, 472, 473, 474, 555, 556; 211/69, 70.6

[56] References Cited

U.S. PATENT DOCUMENTS

| | | | |
|---|---|---|---|
| 2,408,227 | 9/1946 | Ramsey | 206/17 |
| 2,437,595 | 3/1948 | Douglass | 206/17 |
| 2,775,342 | 12/1956 | Smith | 206/17 |
| 3,018,876 | 1/1962 | Huot | 206/17 |
| 3,074,539 | 1/1963 | Rogovin | 206/379 |
| 3,259,748 | 7/1966 | Lammers | 206/45.18 |
| 3,870,149 | 3/1975 | Huot | 206/379 |
| 4,006,821 | 2/1977 | Sautter | 206/45.13 |
| 4,225,038 | 9/1980 | Egly | 206/472 |
| 4,512,467 | 4/1985 | Knoblauch | 206/379 |

FOREIGN PATENT DOCUMENTS

| | | | |
|---|---|---|---|
| 593351 | 5/1959 | Italy | 206/45.13 |

OTHER PUBLICATIONS

IBM, Reamer Box, Jan. 1978.

*Primary Examiner*—Joseph Man-Fu Moy
*Assistant Examiner*—David T. Fidei
*Attorney, Agent, or Firm*—Leo Gregory

[57] ABSTRACT

A drill holding case consisting of a housing, an insert member disposed in said housing, drill holding member carried by the insert, a wall of the housing having a pair of spaced open topped slides formed thereon, the member having a pair of extensions disposed into said slides, the cover having a pair of inward turned flanges from the sides thereof, the sides of said insert member being retained by said flanges.

6 Claims, 5 Drawing Figures

DRILL HOLDING CASE STRUCTURE

BACKGROUND OF THE INVENTION

1. Field of the Invention

This invention relates to drill holding case structure.

2. Description of the Prior Art

Drill holding box or case structures represent a very competitive art. The two general types are those having built in drill holding shelves and those having insertable drill holding members.

The U.S. Pat. No. 2,408,227 to Ramsey is an example of case having built in tiers of drill holding shelves.

In the U.S. Pat. No. 3,870,149 to Huot an example is shown of a drill case having an insertable drill holding fixture.

SUMMARY OF THE INVENTION

This invention relates to an improvement in drill holding case structures, the improvement consisting of a removable drill holding member insertable into a housing.

It is an object of this invention therefore to provide a drill holding case particularly adapted to receive a removable drill holding insert.

It is a further object of this invention to provide a drill holding insert for a housing wherein the insert is operably engaged with the cover of the housing whereby the insert is raised from a position recessed in said housing to an upright position for easy access to the drills held.

It is more specifically object of this invention to provide a drill holding insert for a housing wherein the insert is particularly adapted to have extended portions thereof removable insertable into a vertical slide carried by a wall of the housing and having interengagement with the cover of the housing to be raised to position the drills for ready access.

It is also an object of this invention in view of the immediately previous object, to provide for the ready removal of the insert from the housing.

It is a further object of this invention to provide for the retention of drills in a drill storage chamber.

These and other objects and advantages of the invention will be set forth in the following description made in connection with the accompanying drawings in which like reference characters refer to similar parts throughout the several views.

DESCRIPTION OF A PREFERRED EMBODIMENT

Figure 1:
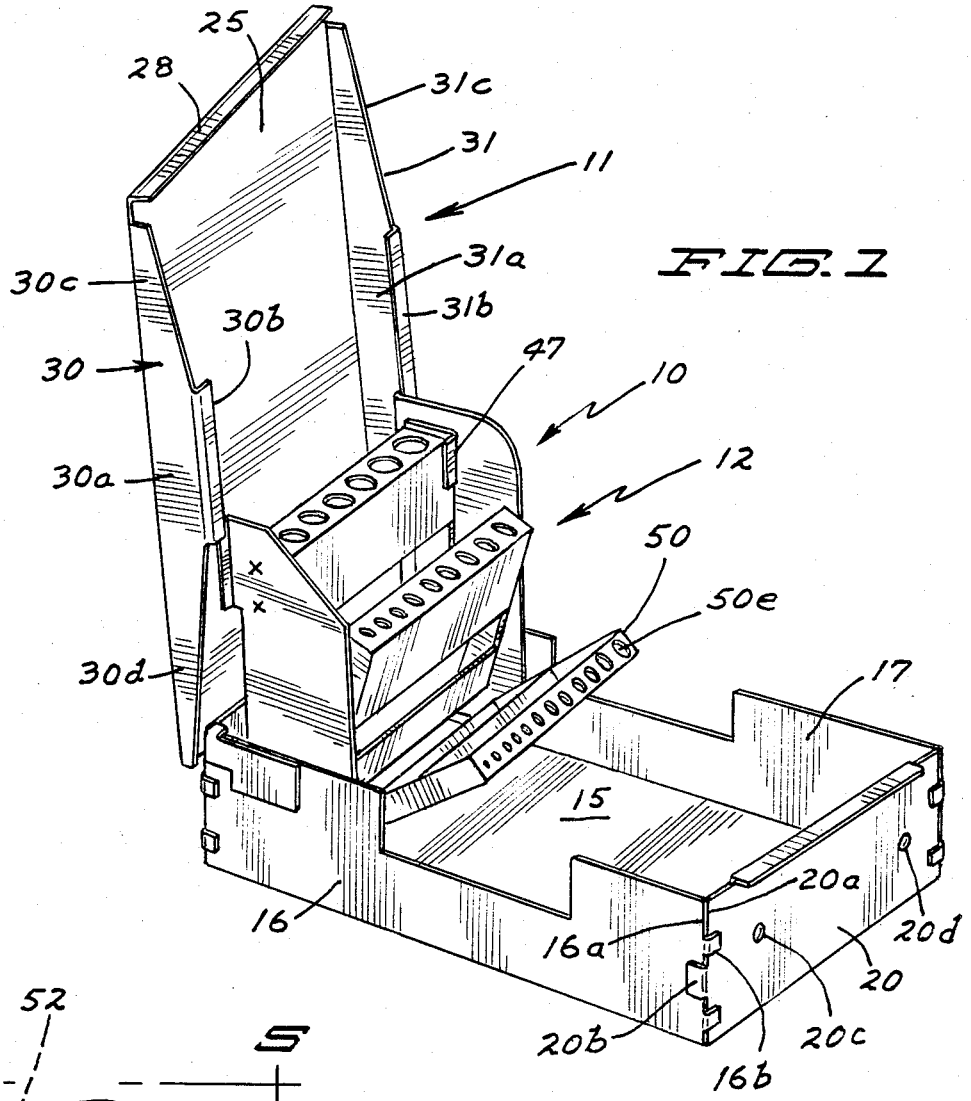
FIG. 1 is a view in perspective of the device herein being shown in open position.

Referring to the drawings, the device herein as indicated generally by the reference numeral 10 and comprises a drill box housing 11 and an insertable drill tray holding member 12.

The housing will first be described. Said housing is here shown consisting of a bottom wall 15 formed of a die cut blank of which side walls 16, 17 and end walls 19, 20 are formed by being angled upwardly along common meeting lines with said bottom wall. The adjacent corners of said walls as at 16*a* and 20*a* are secured together in a conventional manner interengaged by angled projecting tongue portions as indicated at 16*b* and 20*b*.

Said housing is substantially parallelpiped in form and pivoted to the end wall 19 is a cover 25.

Said cover has a top wall 26, a rear wall 27 having a pair of spaced slots 27*a* and 27*b* therein, a narrow front end wall 28 and side walls 30 and 31. Said side walls having central portions 30*a* and 31*a* having inwardly angled flanges 30*b* and 31*b* and from said central portions said walls are shown to taper to their respective ends as at 30*c*, 30*d* and 31*c*, 31*d*.

Said end wall 19 serving as the rear wall has tongue portions 19*a* and 19*b* to be disposed through said spaced slots 27*a* and 27*b* to hingedly secure said cover.

Figure 2:
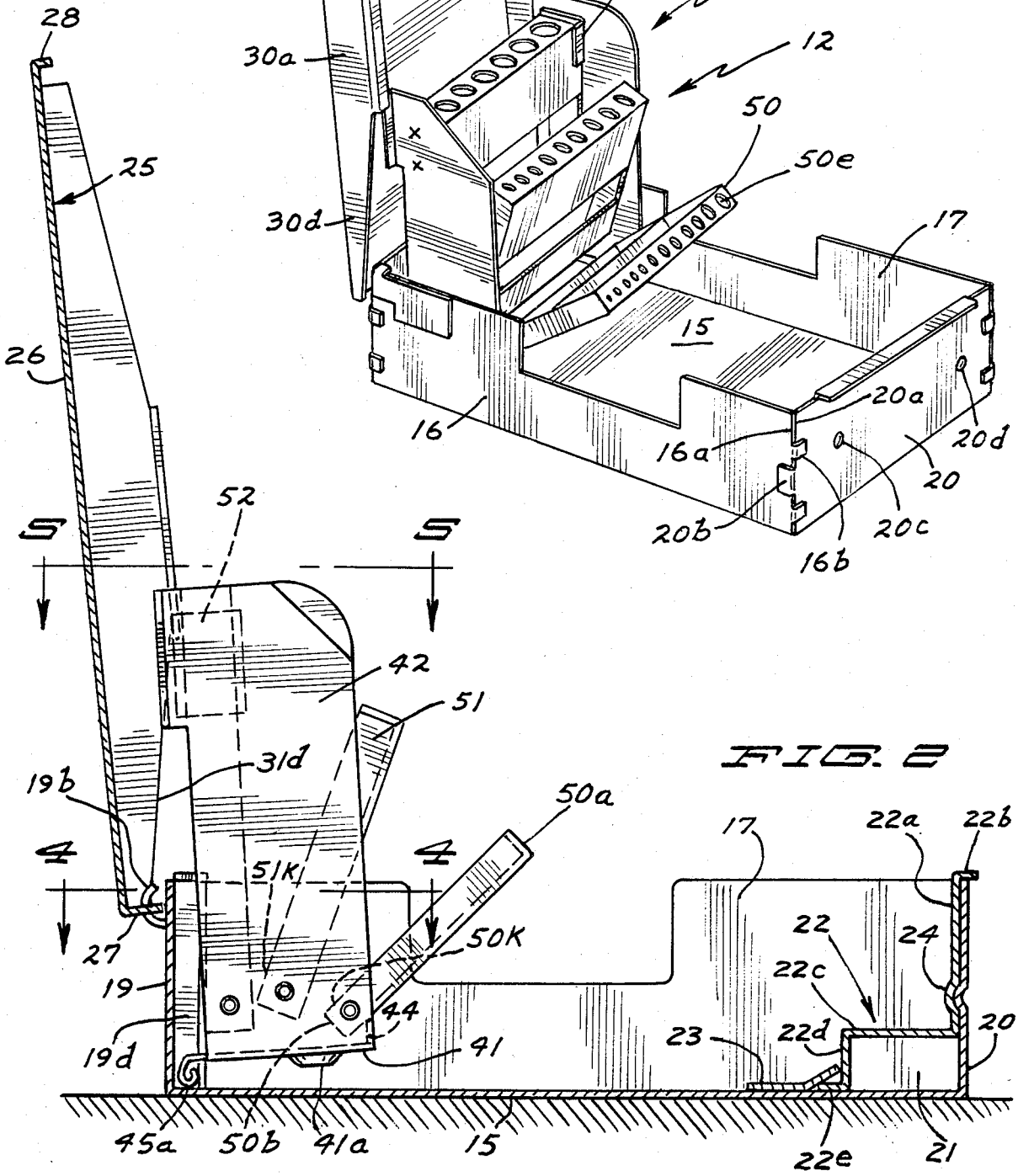
FIG. 2 is a view in vertical longitudinal section of the view in FIG. 1.

At the forward position of the interior of said housing is a storage chamber 21 formed by a step shaped preformed sheet of material 22 having a front wall 22*a* having a projecting lip 22*b*, an angled step 22*c* forming a horizontal wall having a vertical wall 22*d* angled downwardly therefrom and said vertical wall having a rearwardly extending flange 22*e* which is engaged by a pair of spaced clip members 23 secured to the bottom wall 15 and of which only one is shown in FIG. 2. Said front wall has a pair of spaced dimples 24 therein of which one is shown and said wall 20 has a pair of corresponding indentations 20*c* and 20*d* which are in register with said dimples and the same interengage.

The preformed member 22 upon the positioning of the flange 22*e* to engage the clip holding members 23, the front wall 22*a* is pressed downwardly against the housing wall 20 to secure the same in position. Thus said member 22 forms a removable cover for the storage chamber 21.

In designing the back wall 19 in die cutting the same from a blank, not here shown, the ends 19*c* and 19*d* of said wall are extended sufficiently to be reversely angled to form vertical channels within said housing as shown. The channel 19*d* is fully shown in FIG. 3.

Plate members 35 and 36 are welded at the upper rear corners of the side walls 16 and 17 and angled tongues 35*a* and 36*a* are projected therefrom and angled to partially cover the tops of said channels 19*c* and 19*d* being respectively spaced rearwardly of the forward channel walls 19*e* and 19*f* leaving spaces 19*g* and 19*h* therebetween.

Next will be described the insertable drill holding member 12. Said member 12 as here shown consists of a U-channel frame member indicated generally as 40 and consisting of a bottom wall 41, right angled upstanding side walls 42 and 43. Said bottom wall has a narrow front wall 44 and a rearward reversely curved projection 45 having rearward projecting ears 45*a* and 45*b* at each end thereof which are particularly designed to pass through the spaces 19*g* and 19*h* and enter into and slide down to the bottoms of the channels 19*c* and 19*d* to be removably disposed therein.

Struck from said bottom wall 41 are projecting foot or support members as indicated at 41*a* in FIG. 2 (only one being shown).

Said walls 42 and 43 have aligned spaced apertures or eyelets therein indicated at 42*a*, 42*b*, and 42*c* having opposed thereto the corresponding aligned apertures 43*a*, 43*b*, and 43*c*.

Secured to the respective top portions of said side walls 42 and 43 are the opposed angled stop members 46 and 47, the same to be further described.

Said side walls 42 and 43 have upper rearward projecting wall portions 42*d* and 43*d*, the same having outwardly angled flange portions 42*e* and 43*e*, the same to be further described.

Adapted to be removably mounted in said drill tray holding member are drill trays 50, 51, and 52, said trays being respectively taller to hold drills of corresponding lengths.

Said trays are formed to have front, top, bottom and side walls. With reference to tray 50 as representative of the others, said tray has a top wall 50*a*, a bottom wall 50*b* and side walls 50*c* and 50*d* and a front wall 50*h*. Said top wall is apertured as at 50*e*. The apertures are progressively sized to accommodate drill bits of corresponding sizes.

Said tray 50 has punched out of the bottom portion of its side walls a pair of ears 50*f* and 50*g* to be pivotally received into the aligned apertures 42*a* and 43*a*. In like manner, the trays 51 and 52 are mounted within said insert member 12, the tray 51 having ears 51*f* and 51*g* disposed into the holes 42*b* and 43*b*. The tray 52 has ears 52*f* and 52*g* disposed into the aligned apertures 42*c* and 43*c*.

Figure 3:
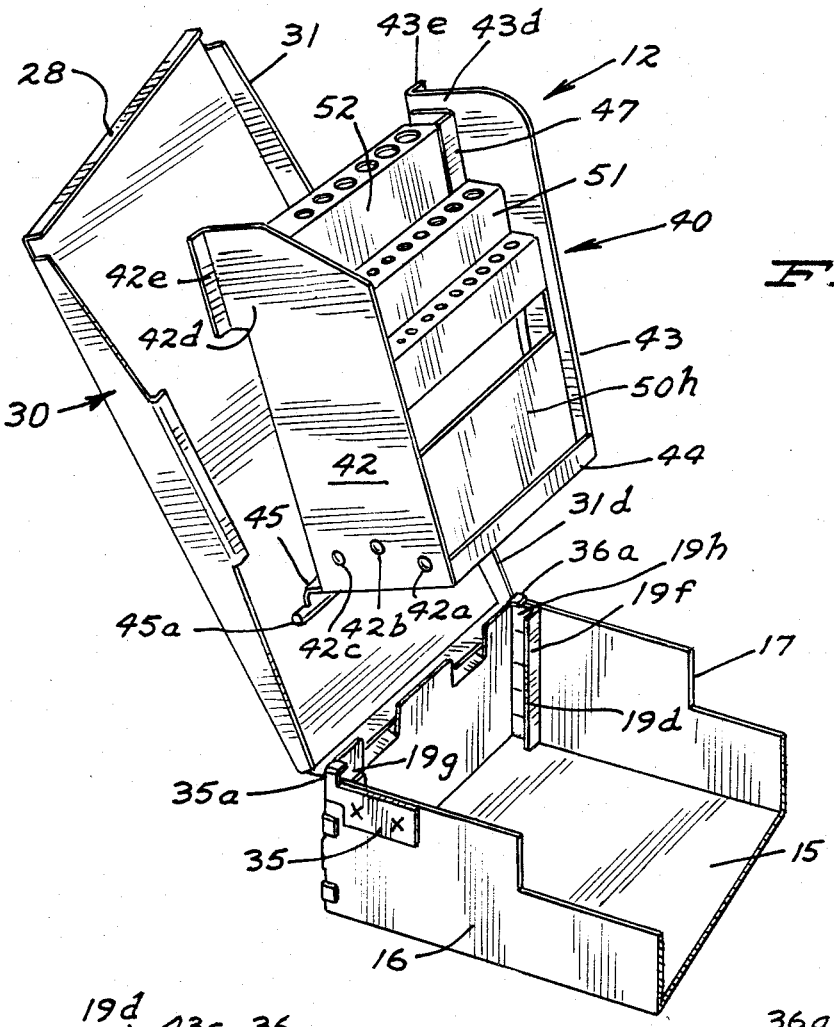
FIG. 3 is an exploded view in perspective with a portion broken away.
Figure 4:
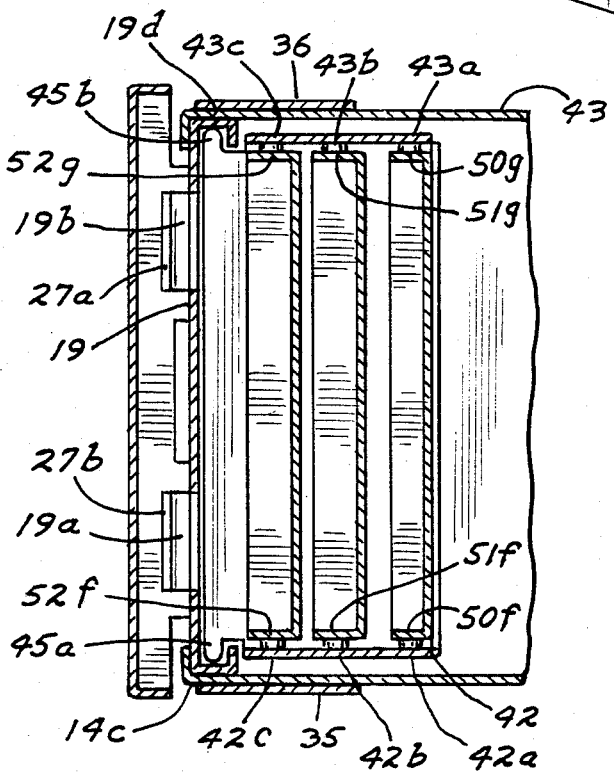
FIG. 4 is a view in horizontal section taken on line 4—4 of FIG. 2 as indicated.
Figure 5:
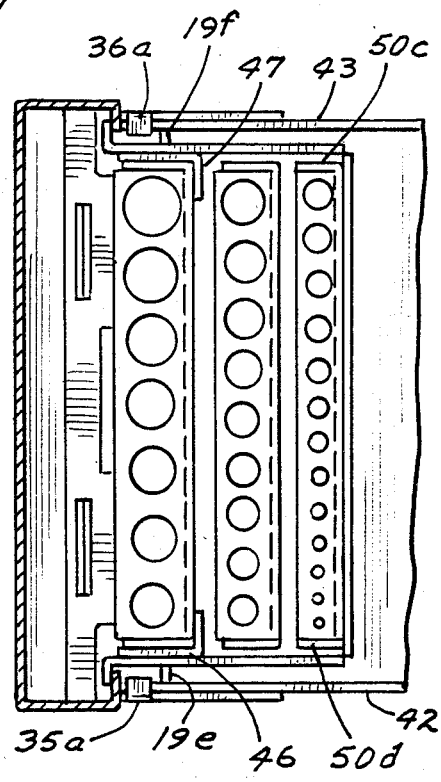
FIG. 5 is a view in horizontal section taken on line 5—5 of FIG. 2 as indicated.

With particular reference FIGS. 1 and 3, it is seen that the flange portions 42*e* and 43*e* underlie the inwardly turned flanges 30*b* and 31*b* of the cover 25. It is seen that when the cover 25 is raised that it will tilt upwardly the drill tray holding member by the sliding engagement of said flanges 30*b* and 31*b* with the flanges 42*e* and 43*e*. With the cover 25 in raised position, the trays 50 and 51 will normally tilt forwardly, limited by the engagement of the bottom edge portion of the tray 51 with that of tray 52 and of the bottom portion of tray 50 with the wall 44 as at 50*k* (see FIG. 2).

When said cover 25 is lowered, the U-shaped member 12 and the trays therein tilt forwardly and when the edge 41 engages the bottom wall 15, the ears 45*a* and 45*b* are moved upwardly in the channels 19*c* and 19*d* retracting said edge portion 41 rearwardly to the point at which said member 12 with the trays therein is horizontally disposed upon said bottom wall 15 of the housing 10.

An essential convenience and a salient point of novelty is the very easy removal of the drill tray holding member 12. This is particularly convenient where the operator has limited work bench space and said tray holder is self standing and takes up very little space disposed in an upright position.

Another important convenience is the storage chamber 22 within which a readily accessible reserve supply of drills may be at hand.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. A drill holding case structure, having in combination a housing having a cover, a substantially U-shaped member having side members, means conecting said side members, a plurality of drill holding trays pivotally mounted into said U-shaped member, a pair of spaced channels formed in said housing in transversely opposed relation, a pair of ears projecting from said U-shaped member disposed into said channels, and interengaging stationary flange members carried by said cover and said U-shaped member whereby movement of said cover raises and lowers said U-shaped member and said trays therein.

2. The structure of claim 1, wherein said interengaging means consists of a pair of flanges formed of said cover interengaging a pair of flanges formed of said U-shaped member.

3. The structure of claim 1, including a drill storage chamber having a removable cover formed within said housing.

4. The structure of claim 1, wherein said interengaging means consists of a pair of inwardly angled portions of said cover engaging outwardly angled portions of adjacent portions of said U-shaped member.

5. A drill holding case structure, having in combination a housing having a chamber therein, a substantially U-shaped member disposed at one end of said chamber, said member having spaced side walls and a bottom wall, a plurality of drill holding trays disposed into said U-shaped member to tilt forwardly thereof, a pair of opposed vertical channels having open facing sides formed in said chamber at one end thereof rearwardly of said U-shaped member, rearward projections extending from the rear of the bottom wall of said U-shaped member disposed into said channels, a cover for said housing, said cover having depending side walls, an inwardly turned flange formed at each of said side walls of said cover, an outwardly turned flange formed at each of said side walls of said U-shaped member, said rearward projections are arranged and constructed to move upwardly within said channels upon the forward bottom edge of said U-shaped member engaging the underlying surface of said chamber whereby said U-shaped member is tilted forwardly horizontally, said first and second mentioned flanges respectively interengaging, whereby when said cover is raised, said trays are tilted to an upward accessible position and when said cover is lowered, said trays are tilted to a downward storage position in said housing.

6. The structure of claim 1, including a stepped preformed cover member disposed within said housing remote from said drill holding trays, said cover member having a depending front wall having a projecting flange, having a top wall and a vertically extending rear wall overlying the adjacent end wall of said housing, forming a chamber thereunder, said front wall and flange engaging the bottom wall of said housing, and means removably securing said cover member.

* * * * *